United States Patent [19]

Pitman et al.

[11] 4,115,244

[45] Sep. 19, 1978

[54] SOLVENT DEWAXING PROCESS

[75] Inventors: Herbert J. Pitman; Charles W. Harrison, both of Nederland; Avilino Sequeira, Port Arthur, all of Tex.

[73] Assignee: Texaco Inc., New York, N.Y.

[21] Appl. No.: 813,144

[22] Filed: Jul. 5, 1977

[51] Int. Cl.[2] ..... C10G 43/08

[52] U.S. Cl. ..... 208/33; 208/37

[58] Field of Search ..... 208/33

[56] References Cited

U.S. PATENT DOCUMENTS

| | | | |
|---|---|---|---|
| 3,249,526 | 5/1966 | Bodington | 208/33 |
| 3,850,740 | 11/1974 | Gudelis et al. | 208/33 |

OTHER PUBLICATIONS

Chen et al., "Chemical Engineering" Mar. 19, 1973, pp. 105 -111.

*Primary Examiner*—Herbert Levine

*Attorney, Agent, or Firm*—Carl G. Ries; Thomas H. Whaley; Douglas H. May, Jr.

[57] ABSTRACT

A process for dewaxing a waxy petroleum distillate charge stock, wherein a mixture of waxy oil and solvent, heated for dissolving all solid wax therein, is cooled to a first temperature about 40°-50° F (22° to 28° C) above a selected separation temperature, and is held at such first temperature for a period of 1-2 minutes for equilibrating wax crystallization, wherein said oil-solvent mixture, at said first temperature, is cooled to a second temperature about 15°14 20° F (8°-11° C) above said separation temperature and is held at said second temperature for 1-2 minutes for equilibration of wax crystallization, wherein said oil-solvent mixture, at said second temperature, is cooled to said separation temperature, and wherein solid wax is separated from oil-solvent mixture at said separation temperature.

7 Claims, 1 Drawing Figure

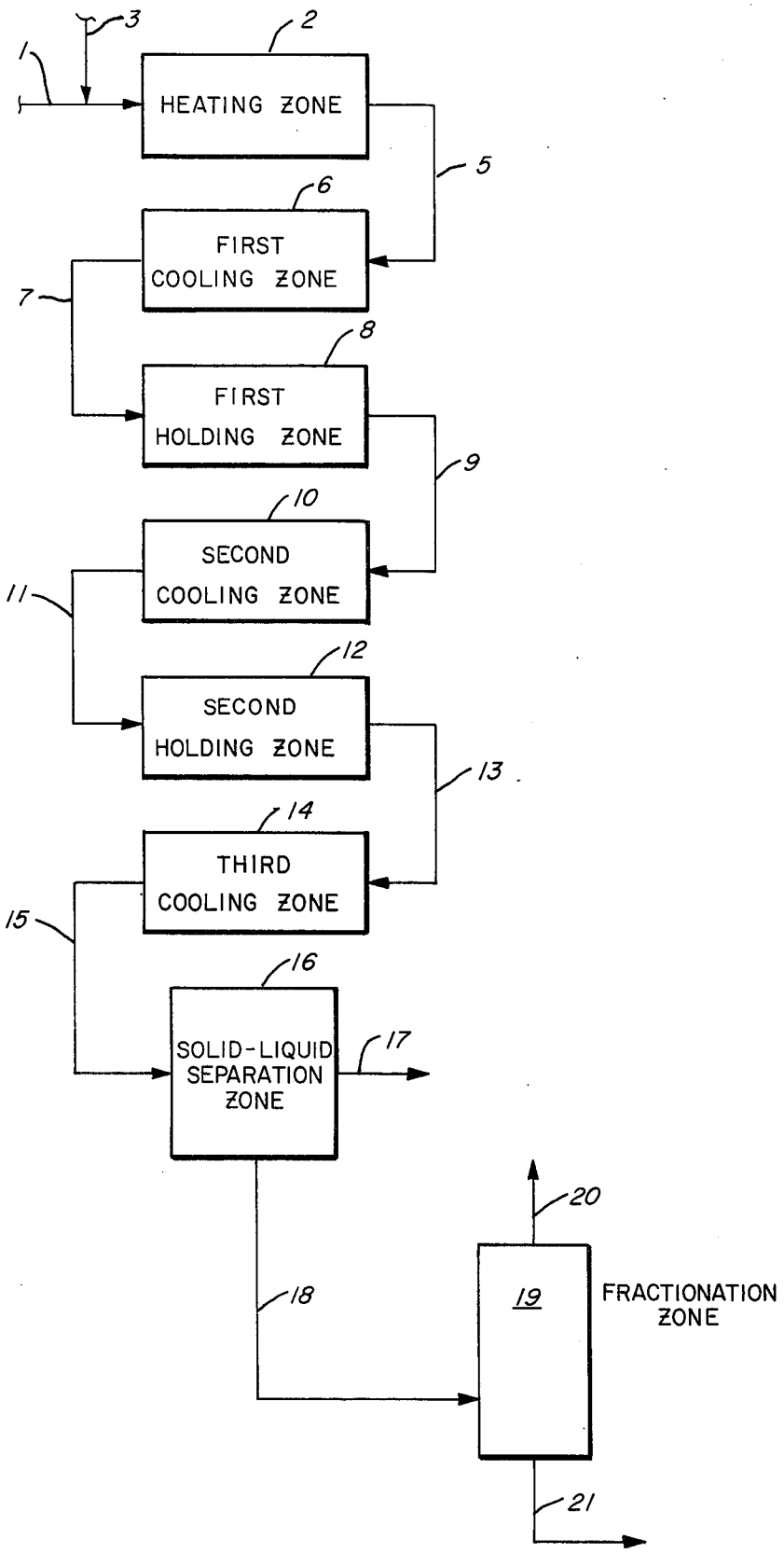
1
2
3
HEATING ZONE
5
6
FIRST COOLING ZONE
7
8
FIRST HOLDING ZONE
9
10
SECOND COOLING ZONE
11
12
SECOND HOLDING ZONE
13
14
THIRD COOLING ZONE
15
16
SOLID-LIQUID SEPARATION ZONE
17
18
19
FRACTIONATION ZONE
20
21

SOLVENT DEWAXING PROCESS

BACKGROUND OF THE INVENTION

The present invention relates to a solvent dewaxing process for dewaxing waxy distillate petroleum oil stocks. More particularly, the invention relates to a solvent dewaxing process wherein a mixture of heated waxy distillate oil stock and dewaxing solvent is cooled in a first cooling zone, to a temperature about 40°-50° F. (22° to 28° C.) above a selected separation temperature in the range of about +15° to −20° F. (−9° to −30° C.) and is held, in a first holding zone, for about ½-2 minutes for equilibration of wax crystallization, wherein the wax/oil/solvent mixture from said first holding zone is cooled, in a second cooling zone, to a temperature about 15°-20° F. (8° to 11° C.) above said selected separation temperature and is held, in a second holding zone, for a period of about ½-2 minutes for equilibration of wax crystallization, wherein the wax/oil/solvent mixture from said second holding zone is cooled, in a third cooling zone to said selected separation temperature in the range of about +15° to −20° F. (−9° to 30° C.), for crystallization of additional wax, and wherein solidwax is separated from the wax/oil/solvent mixture from said third cooling zone in a solid-liquid separation zone.

DESCRIPTION OF THE PRIOR ART

It is known in the prior art to dewax waxy petroleum oil stocks by cooling oil-solvent solutions at uniformly slow rates, of e.g. 1°-8° F./min (0.56°-4.4° C./min), under controlled conditions for crystallization of wax from said solutions. Commercially, such oil-solvent solutions are cooled by several methods such as indirect heat exchange in scraped surface exchangers; dilution chilling wherein waxy oil stock is contacted in a multistage tower with chilled solvent under conditions of high levels of agitation (U.S. Pat. No. 3,773,560); and direct chilling, wherein a low boiling solvent, e.g. propylene, mixed with waxy oil stock is vaporized under conditions of reduced pressure.

In such commercial processes, the waxy oil charge, or solutions of waxy oil charge and solvent, are heated to a temperature at which all the wax present is dissolved. The heated charge is then passed into a cooling zone wherein cooling is undertaken at a uniform slow rate in the range of about 1°-8° F./minute (0.56°-4.4° C./min) until a temperature is reached at which a substantial portion of the wax is crystallized and at which dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil (slack-wax). The separated oil-solvent solution is subjected to fractional distillation for recovery of a solvent fraction and a dewaxed oil product fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3-6 carbon atoms, $C_2$-$C_4$ range hydrocarbons, $C_6$-$C_7$ aromatic hydrocarbons, halogenated $C_1$-$C_4$ hydrocarbons, and mixtures of such solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

For processes employing indirect cooling in scraped surface exchangers, cooling and wax crystallization are accomplished under conditions of very little agitation at a cooling rate in the range of about 1°-8° F./minute (0.56°-4.4° C./min). Under such conditions, without wall scrapers, wax tends to accumulate on the cold exchanger walls, interfering with heat transfer and causing increased pressure drop. Thus, wall scrapers are employed to remove the accumulated wax. Dewaxing solvents are employed to maintain fluidity of the oil in the coolers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil resulting in formation of many small wax crystals which are difficult to separate. Under controlled conditions, elongated wax crystals of good size are formed which are easy to separate and which contain little occluded oil.

Dilution chilling processes employ incremental addition of cold solvent, e.g. to +20° to −25° F. (−6.7° to −32° C.) to the oil high degrees of agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution for separation of solid-wax from the oil-solvent solution. The low boiling hydrocarbon is vaporized from the oil-low boiling hydrocarbon solution, under conditions of reduced pressure, at a rate sufficient to cool the solution about 1°-8° F./min (0.56°-4.4° C./min). Such cooling is continued until the desired separation temperature and amount of wax crystallization are obtained. At the separation temperature, suficient low boiling hydrocarbon remains in solution with the oil to provide the desired fluidity for separation of wax. Agitation of the mixture being cooled is commonly provided for reduction of temperature and concentration gradients.

In these processes of the prior art, rotating mechanical equipment, either wall scrapers or high speed agitators, are employed to facilitate good heat transfer from the oil. Such mechanical equipment is expensive, difficult to maintain, and can contribute to breaking and deformation of wax crystals.

SUMMARY OF THE INVENTION

Now, according to the present invention we have discovered improvements to continuous solvent dewaxing processes for separating solid wax from waxy distillate petroleum oil stocks, wherein said waxy oil stock, heated to a temperature sufficient to dissolve all wax in said oil stock, is treated with dewaxing solvent in a volume ratio of solvent to oil stock in the range of 1:1 to 5:1 respectively, wherein said mixture of oil and solvent is cooled at a rate of about 1°-8° F./minute (0.56°-4.4° C./min) to a selected separation temperature in the range of +15° F. to −40° F. (−9° to −40° C.) for forming a mixture of wax crystals in oil-solvent solution, wherein said mixture is separated, in a solid-liquid separation zone, into a dewaxed oil-solvent solution and slack wax, and wherein said separated solution is fractionated, in a fractionation zone, to yield a solvent fraction and a dewaxed oil fraction; the improvement comprising:

a. cooling, in a first cooling zone, a mixture, comprising waxy oil stock and dewaxing solvent in a solvent/oil volume ratio of about 1:1 to 5:1, and having an initial temperature above the depressed cloud point, at a rate of about 1°-8° F./min (0.56° to 4.4° C./min) to a second temperature about 40°-50° F. (22° to 28° C.) above a selected separation temperature, under conditions of plug flow radial mixing, for crystallization of a portion of the wax from said waxy oil stock and forming a wax/oil/solvent mixture;

b. flowing said wax/oil/solvent mixture from said first cooling zone, at said second temperature, through a first holding zone under conditions of plug flow radial mixing, for a period of about 30 seconds to 2 minutes for equilibrating wax crystallization;

c. cooling, in a second cooling zone, the wax/oil/solvent mixture from said first holding zone, at a rate of 1°-8° F./min (0.56° to 4.4° C./min), under conditions of plug flow radial mixing, to a third temperature about 15°-20° F. (8° to 11° C.) above said selected separation temperature for crystallization of additional wax from said waxy oil stock;

d. flowing said wax/oil/solvent mixture from said second cooling zone, at said third temperature, through a second holding zone under conditions of plug flow radial mixing, for a period of about 30 seconds to 2 minutes for equilibrating wax crystallization;

e. cooling, in a third cooling zone, the wax/oil/solvent mixture from said second holding zone, at a rate of 1°-8° F./minute (0.56° to 4.4° C./min) to said selected separation temperature in the range of about +15° F. to −40° F. (−9° to −40° C.) under conditions of plug flow radial mixing for crystallization of additional wax from said waxy oil stock; and f. flowing said wax/oil/solvent mixture from said third cooling zone, at said selected separation temperature, to said solid-liquid separation zone.

The advantages of the present invention over processes of the prior art include elimination of at least a portion of the rotating mechanical equipment such as wall scrapers and/or agitators from the dewaxing process. Elimination of rotating mechanical equipment reduces cost of constructing solvent dewaxing facilities, and reduces manpower, expense and downtime required for operating and maintaining such rotating mechanical equipment. Flowing wax/oil/solvent mixture through holding zones under conditions of plug flow radial mixing improves mass transfer in the mixture, such that crystalization of wax from waxy oil stock, at the holding zone temperature, approaches equilibrium and supersaturation of wax in oil/solvent solution is avoided.

Plug flow radial mixing in the cooling zones results in improved heat transfer from the oil-solvent mixture and reduces operating costs by improving efficiency. However, the greatest advantage is that transverse temperature differentials across the cross-sectional area of flowing oil-solvent mixture, from the cold wall to the center of the oil-solvent mixture is reduced to about 1° F. (0.56° C.) or less, such that substantial subcooling of portions of the mixture close to the walls is avoided, thus reducing deposition of wax upon said cold walls. These advantages, and others will be explained more fully in the detailed description which follows.

BRIEF DESCRIPTION OF THE DRAWING

The drawing is a schematic representation of a solvent dewaxing process employing improvements of the present invention.

DESCRIPTION OF TERMS

Waxy petroleum distillate oil stocks are contemplated as charge stocks to the solvent dewaxing process of the present invention have a viscosity of less than 350 SUS at 100° F. and have a boiling range of about 600°-650° F. (315°-343° C.) initial boiling point to about 1050°-1100° F. (566° to 593° C.) end point. Such waxy petroleum distillate oil stocks may be derived from raw lube oil stocks, the major portion of which boil above about 650° F. (343° C.). Such raw lube oil stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Preferably, paraffinic crude oils are used as sources of lube oil stocks. Such distillate streams contain aromatic and polar compounds which are undesirable in lubricating oils. Such compounds may be removed, by means such as solvent extraction, hydrogenation, and other means well known in the art, either before or after solvent dewaxing. Treatment of distillate streams for removal of aromatic and polar compounds before solvent dewaxing reduces the volume of oil to be dewaxed, which concomitantly reduces the amount of solvent employed, refrigeration load, etc.

The wax content of a waxy distillate oil stock is defined by the amount of material to be removed to produce a dewaxed oil with a selected pour point temperature in the range of +25° to −40° F. (−3.9° to −40° C.). Wax content of waxy distillate oil stock will vary in the range of 5 to 35 wt. percent. The wax material removed in solvent dewaxing is a complex mixture of straight chain and branched chain paraffinic and napthenic hydrocarbons. Wax from light distillate oil stocks generally predominantly comprises normal paraffin hydrocarbons which have relatively high crystal growth rates, whereas wax from heavier oil stocks is a complex mixture of straight chain and branched chain paraffin and naphthenic hydrocarbons which have slower crystal growth rates. In solvent dewaxing processes, wax is separated as solid crystals.

Dewaxed oil, as the term is used herein, is the product from the dewaxing process after solid wax and solvent have been removed.

Pour Point is the temperature at which an oil will cease to flow when chilled under prescribed conditions (ASTM-D-97-66). The pour point temperature of an oil stock is reduced in solvent dewaxing processes by removing wax therefrom. The pour point temperature of dewaxed oil determines the useful temperature range of lubricating oil manufactured therefrom, and is indicative of other properties such as viscosity, etc.

The Cloud Point is the temperature at which a cloud or haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type of mixture of solvents employed, etc.

Dewaxing Solvent which may be used in the process of the present invention may be selected from: aliphatic ketones of 3 to 6 carbon atoms; lower molecular weight hydrocarbons e.g. ethane, propane, butanes, and particularly propylene; atomatic hydrocarbons such as benzene and toluene; halogenated low molecular weight hydrocarbons of 1 to 4 carbon atoms, e.g. dichlorethane, methylene chloride, etc.; and mixtures of the above. Useful dewaxing solvent mixtures are: mixtures of methyl ethyl ketone and methyl isobutyl ketone; mixtures of ketones with propylene; mixtures of ketone with $C_6$-$C_7$ aromatic hydrocarbons and mixtures of dichloroethylene and methylene chloride. Particularly useful in the process of the present invention are mixtures comprising 30–70 volume percent methyl ethyl ketone and 70–30 volume percent toluene.

Solvent Dilution, within contemplation of the present invention comprises diluting the waxy oil charge stock with solvent, in volume ratios in the range of about 1:1 to 5:1 solvent to oil, for improving wax removal from the oil; maintaining fluidity of the oil under cooling, or chilling, conditions; obtaining optimum wax separation rates; and obtaining optimum dewaxed oil yields. The extent of solvent dilution is dependent upon the particular waxy oil stock, the solvent system employed, the extent of cooling in the cooling zone, and the desired final viscosity of the wax/oil/solvent mixture going to the wax separation zone. In the prior art it is known that solvent may be added to waxy oil stock before cooling commences, (referred to as predilution), in increments as the oil stock is cooled, at the exit from the cooling zone, or by a combination of the above methods. One solvent may be added at one point in the solvent dewaxing process and another at another point, or the same solvent (or mixture of solvents) may be employed throughout. Generally, it has been observed that addition of a cold solvent (e.g. in the range of 0° to −50° F. (−18° to −45° C.) to a warmer waxy oil stock, must be accompanied by vigorous agitation for formation of large, easily separated wax crystals. Without vigorous agitation, cold solvent injected into waxy oil stock shock chills the oil and tends to form extremely small wax crystals which are difficult to separate.

Plug Flow Radial Mixing refers to mixing the solvent-oil mixture in a tubular mixing zone by splitting the flowing fluid into two or more strata each of which is then helically rotated in one direction about its hydraulic center resulting in radially mixing the flowing fluid such that fluid is forced from the center of the tubular mixing zone outward to the outer wall of the tube, and vice versa, then splitting these strata into two or more additional strata, each of which is then helically rotated in the opposite direction about its hydraulic center, etc. The overall effect of such mixing is to cause the flowing stream to be continuously divided and redivided into strata which are continuously radially inverted, such that elements of the fluid entering at the center of the flowing stream are forced to the outer wall, and vice versa, on a continuous basis. Such radial mixing is accomplished with very little backmixing such that the flow of fluid approximates plug flow. Flow of fluid may be in the laminer range or in the turbulent range. In such plug flow radial mixing, transverse gradients in temperature, velocity and composition are substantially reduced or eliminated. Additionally, heat transfer from the body of flowing fluid to the wall of the mixer is substantially increased. Mechanical devices to accomplish such plug flow radial mixing may be obtained from Kenics Corporation, and are described in "MOTIONLESS MIXERS FOR VISCOUS POLYMERS", Chen and MacDonald, *Chemical Engineering,* Mar. 19, 1973, p. 105ff. In the present invention, plug flow radial mixing makes three important contributions to the process: Transverse temperature differences across the flowing fluid are reduced to 1° F. (0.56° C.) or less in the cooling zones such that super cooled oil-solvent mixture does not reside at the cold wall, depositing wax thereon; the flow of oil-solvent mixture is directed at the cold wall, scouring away any wax which may accumulate; and in the holding zones, the wax/oil/solvent mixture is rapidly blended into a mixture having a uniform composition and temperature throughout, such that wax crystallization equilibrium is readily achieved.

Cooling Rate of a waxy oil stock-solvent mixture, in solvent dewaxing processes generally and the process of the present invention particularly, has been observed to be determinate of the size of wax crystals formed in the wax/oil/solvent mixture. Lower cooling rates yield larger, easy to separate crystals, with less oil occluded therein. Conventionally, oil-solvent mixtures are cooled at uniform slow rates in the range of 1°–8° F. per minute (0.56° to 4.4° C./min). Preferably cooling rates are in the range of 1.5°–5° F. per minute (0.83° to 2.78° C./min). Although larger wax crystals containing less occluded oil are formed at lower cooling rates, economy demands that the rate be at least about 1° F. per minute (0.56° C./min). At cooling rates above about 8° F. per minute (4.4° C./min), the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax crystallization as new nuclei or as growth of existing crystals, lags as a result of mass transfer, such that the mixture is somewhat supersaturated. Nucleation of new wax crystals is favored over crystal growth at higher degrees of supersaturation which result from higher cooling rates. Thus, the lowest economical cooling rate is to be preferred. When waxy oil stock, or oil-solvent mixtures are cooled to the cloud point, a very large number of small wax crystal nuclei precipitate forming a haze or cloud in the mixture. Under conditions of uniform slow cooling, in the 1°–8° F. per minute (0.56° to 4.4° C./min) range, these small crystals tend to grow into larger, easily separable crystals at the expense of formation of additional small wax crystal nuclei as the temperature is reduced.

DESCRIPTION OF THE DRAWING

For better understanding the process of the present invention reference is now made to the drawing. The drawing is a schematic representation of a solvent dewaxing process employing improvement of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate an embodiment of the present invention, and are not to be construed as limitations of the invention which is set-out in the claims appended to this application.

In the drawing, waxy petroleum distillate oil stock (waxy oil stock) having physical properties within ranges heretofore set-out in the specification flows continuously, via line 1, into heating zone 2. Dewaxing solvent is added to the waxy oil stock in an amount equivalent to about 1–5 volumes of waxy oil stock. In one alternative, dewaxing solvent may be added to the waxy oil stock via line 3, prior to heating zone 2, or, in a second alternative, may be added to the heated waxy oil stock following heating zone 2.

In the first alternative, dewaxing solvent may be added to the waxy oil stock without substantial mixing and without substantial regard to temperature, as mixing and temperature equilibration will occur in heating zone 2. However, additional heat must generally be provided for heating the dewaxing solvent. In the second alternative, dewaxing solvent may be added at temperatures as low as about 50° F. (10° C.) without shock chilling the waxy oil stock, thus saving heat in heating zone 2 and reducing cooling required in a first cooling zone 6 (hereinafter described).

In the drawing, according to the first alternative, in heating zone 2, the waxy oil stock and dewaxing solvent are heated by indirect heat exchange to a first temperature, e.g. about 80°–160° F. (26.7° to 71° C.), at which all wax present is melted and a completely liquid solution results. Dewaxing solvent is selected from known dewaxing solvents, as heretofore set-out in this specification. Particularly useful dewaxing solvents are mixtures comprising about 30–70 vol. percent methyl ethyl ketone, and about 70–30 vol. percent toluene, although other dewaxing solvents such as mixtures of methyl ethyl ketone and methyl isobutyl ketone, and mixtures of ethylene dichloride and methyl chloride may be used to advantage. The amount of solvent is in the range of 1–5 volumes of waxy oil stock, and, for example, is commonly in the range of about 3–4 volumes of waxy oil stock when the solvent is a mixture of methyl ethyl ketone-toluene. Dilution of lighter and heavier waxy oil stocks within contemplation of the present invention may require respectively somewhat less or somewhat more solvent for otpimum effectiveness.

In the drawing, the heated mixture of waxy oil stock and dewaxing solvent having all the wax dissolved therein flows from heating zone 2 via line 5 into first cooling zone 6. In first cooling zone 6, the oil/solvent mixture is cooled at a uniform rate in the range of 1°–8° F./min (0.56° to 4.4° C./min), and preferably at 1.5°–5° F./min (0.83° to 2.8° C./min), to a second temperature about 40°–50° F. (22°–28° C.) above a selected separation temperature. The selected separation temperature is in the range of about +15° F. to −20° F. (−9° to −30° C.), and is selected for crystallizing sufficient wax from the waxy oil stock to provide a dewaxed oil product of desired quality. During this cooling step in first cooling zone 6, wax crystallizes from the oil/solvent mixture, forming wax crystal nuclei. Cooling in cooling zone 6 is contemplated to be via indirect heat exchange with a refrigerant fluid or via direct heat exchange by vaporizing a portion of dewaxing solvent, such as propylene, at reduced pressure. Cooling of the oil/solvent solution in cooling zone 6 may be accomplished with or without agitation, and, in the case where indirect heat exchange is employed, wall scrapers for removing precipitated wax may be employed. Preferably, however, cooling is undertaken in first cooling zone 6 under conditions of indirect heat exchange under conditions of plug flow radial mixing.

In the drawing, cooled wax/oil/solvent mixture from first cooling zone 6 flows via line 7 into first holding zone 8. In first holding zone 8, the wax/oil/solvent mixture is mixed, by plug flow radial mixing, without substantial heat exchange to or from the wax/oil/solvent mixture, for a period of about 30 seconds to 2 minutes. In holding zone 6 concentration and temperature gradients are eliminated, and mass transfer of wax from waxy oil stock to wax crystals is equilibrated, such the wax/oil/solvent mixture exiting first holding zone 8 is in substantial equilibrium.

In the drawing, from first holding zone 8, wax/oil/solvent mixture flows via line 9 to second cooling zone 10. In first cooling zone 10, the wax/oil/solvent mixture is cooled at a rate of about 1°–8° F./min (0.56° to 4.4° C./min), and preferably about 1.5°–5° F./min (0.8° to 2.8° C./min) to a temperature about 15°–20° F. above the selected separation temperature. As in first cooling zone 6, cooling may be by direct or indirect heat exchange, with or without agitation, although cooling by indirect heat exchange under conditions of plug flow radial mixing is preferred.

In the drawing, wax/oil/solvent mixture from second cooling zone 10 flows via line 11 into second holding zone 12. In second holding zone 12, the wax/oil/solvent mixture at is subjected to plug flow radial mixing without substantial heat of about 30 seconds to 2 minutes. Concentration and thermal gradients are eliminated, and mass transfer of wax from waxy oil stock to wax crystals is equilibrated, such that the wax/oil/solvent mixture leaving second holding zone 12 is in substantial thermal and concentration equilibrium.

In the drawing, from second holding zone 12, the wax/oil/solvent mixture flows via line 13 to third cooling zone 14. In third cooling zone 14 the wax/oil/solvent mixture is cooled to the selected separation temperature in the range of about +15° to −20° F. (−9° to −30° C.), at a rate of about 1°–8° F./min (0.56°–4.4° C./min), preferably about 1.5°–5° F./min (0.8° to 2.8° C./min), for crystallizing additional wax from the waxy oil stock. In third cooling zone 14, sufficient wax is crystallized to reduce the pour point of the remaining oil to a desired value for use in lubricating oils. As in first cooling zone 6 and in second cooling zone 10, cooling in third cooling zone 14 may be by direct or indirect heat exchange, with or without agitation, although cooling by indirect heat exchange under conditions of plug flow radial mixing is preferred.

In the drawing, wax-oil-solvent mixture, at the selected separation temperature obtained in cooling zone 14, flows via line 15 to solid-liquid separation zone 16 wherein wax crystals are separated from oil-solvent solution. Solid-liquid separation may be accomplished by solid-liquid separation methods known in the art, such as gravity settling, centrifugal separation, filtration, etc. Preferably, and commonly practiced in commercial processes, wax is separated from oil-solvent solutions by vacuum filtration. That is, wax/oil/solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and wash solvent is sprayed upon the filter cake to displace additional oil. Wash solvent, which may be the same or different from the dewaxing solvent, is likewise pulled through the filter cloth by vaccum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air, or a scraper such as a doctor knife, and the rotating drum carries the filter cloth into the holding tank for contact with additional wax-oil-solvent mixture.

In the drawing, wax from solid-liquid separation zone 16 known as slack wax and containing some oil entrained therein, is recovered via conduit 17 for further refining or for recovery as is. Separated oil-solvent solution, from solid-liquid separation zone 16, flows via line 18 to fractionation zone 19. In fractionation zone 19, the oil-solvent solution is separated into a solvent fraction which is recovered via overhead line 20, and a dewaxed oil fraction which is recovered as product via line 21.

In the process of the present invention, it is contemplated that waxy oil charge stock will be suitable for manufacture of lubricating oils. Thus, a particular waxy oil charge stock will have a boiling range, viscosity, and composition suitable for manufacturing a particular lubricating oil. Solvent dewaxing is performed for removing wax from the waxy charge stock, thereby lowering the pour point temperature to a value suitable for the particular lubricating oil being manufactured. Other refining processes, outside the scope of the present invention, such as solvent extraction, hydrogenation, etc. are commonly performed on the waxy oil charge stock and/or the dewaxed oil for adjusting other properties of the oil, such as viscosity index, to values suitable for the particular lubricating oil.

Production of lubricating oils is relatively low volume operation, compared to other petroleum refining operations. Consequently in commercial solvent dewaxing operations it is common practice to process one waxy oil stock at one time and other waxy oil stocks at other times, in blocked out operation.

Heating waxy oil stock in heating zone 2 is preferably by indirect heat exchange from a heating medium such as steam, hot gas, or other heat transfer fluid to the waxy oil stock. Heating zone 2 may conveniently be a heat exchanger such as a shell and tube exchanger, a double pipe exchanger, etc., or heating zone 2 may comprise heating coils suspended in a waxy oil stock storage tank. Heat is transferred from the heating fluid to the waxy oil stock primarily by convection. Maximum temperatures necessary for dissolving all the wax in the waxy oil stocks and solvents contemplated for processing according to the present invention do not exceed about 160° F. (71° C.) and commonly do not exceed about 130° F. (54.4° C.). Consequently, heat exchangers having high radiant heat flux, and hot tube walls, such as direct fired heaters, are not preferred for this service.

In holding zones 8 and 12, waxy oil and solvent are mixed by plug flow radial mixing to thoroughly mix the oil and solvent. Plug flow radial mixing oil and solvent provides thorough mixing without use of rotating mixing equipment, consequently construction, operating and maintenance expenses are substantially reduced over conventional dewaxing processes. Plug flow radial mixing, as previously described, comprises a series of steps wherein the flowing stream to be mixed is divided into strata, and each strata is rotated about its hydraulic center, forcing liquid from the center of the flowing streams to the outer walls, and liquid from the outer walls to the center. The next succeeding mixing step redivides the strata from the first step into new divisions, each comprising portions of all the strata from the first step, and rotates the new divisions in the opposite direction about their hydraulic center. Thus in each mixing step, each strata of the liquid (in this case waxy oil stock and solvent) is mixed, and in the next succeeding step, portions of each strata are mixed with each other. In order to obtain the degree of mixing desired for waxy oil and solvent in the present process, about 100,000 to about 1,000,000 divisions and redivisions (strata) of the waxy oil and solvent are required. This degree of mixing requires from about 9 to about 20 mixing elements in the plug flow radial mixer. The number of mixing elements will be determined by the degree of mixing and the type of mixer selected. Some commercially available plug flow radial mixers divide the flow into two strata at each step, and some mixers divide the flow into four strata at each step.

In plug flow radial mixing, a discreet amount of mixing is accomplished by each element at each step. Thus, unlike agitation, where more or less mixing at each stage can be accomplished by increasing or decreasing residence time and/or agitator speed in that stage, residence time does not contribute substantially to the degree of mixing. In plug flow radial mixing, the liquid to be mixed must pass through a certain number of stages for a certain degree of mixing. In the present invention. As each element of the plug flow radial mixers occupies a length of equivalent about 1.5 diameters of the tubular mixing zone, and as mixing zones for commercial scale solvent dewaxing units may conveniently be about 6 inches (15.24 cm) in diameter, a minimum velocity of about 0.5 ft/sec (0.15 m/sec) for solvent and oil in the mixing zone is desirable. Stated in a more generalized way, the preferred minimum velocity of solvent and oil in the mixing zone is equivalent to about one mixing zone diameter per second. A maximum to the flow velocity ofwaxy oil and solvent in the mixing zone is also desirable. This maximum is preferably equivalent to about eight mixing zone diameters per second (about 4 ft/sec. (1.22 m/sec) for a 6 inch (15.24 cm. diameter). For wax/oil/solvent mixtures entering holding zones 8 and 12, from cooling zones 6 and 10, small regions of temperature and concentration discontinuities occur. The temperature and concentration discontinuities are equilibrated as the oil and solvent are thoroughly mixed. In cooler regions, wax nuclei will form, while in warmer regions wax will remain in solution. As the oil and solvent are mixed and the temperature and concentration gradients equilibrate some of the lower melting point wax nuclei formed in the cooler regions will melt and some wax from the warmer regions will crystallize as wax nuclei. This melting and crystallization of wax, that is equilibrating of wax nuclei, takes a little time, and it is desirably completed before the next succeeding cooling step. Residence time in the range of about 30 seconds to about 2 minutes, at velocities proposed herein, give sufficient time for the wax nuclei to equilibrate.

Cooling in cooling zones 6, 10, and 14 is preferably via indirect heat exchange from oil-solvent mixture to a refrigerant fluid, preferably in double pipe heat exchangers. Such double pipe heat exchangers may be equipped with scrapers for removing any deposited wax from the cold exchanger walls. Preferably, however, such rotating mechanical equipment is replaced with stationary plug flow radial mixers. Plug flow radial mixing of the wax-oil-solvent mixture in the cooling zones reduces transverse temperature differentials across the flowing mixture to about 1° F. or less, such that super cooling of the mixture at the cold wall, and concomitant precipitation of low melting point wax at the cold wall, are avoided. Precipitation of low melting point wax, in a cold zone near the cold wall produces two undesirable effects. The low melting point wax, when exposed to warmer oil-solvent mixture becomes tacky or sticky. This sticky wax then tends to stick to the cold wall of the exchanger, thus contributing to wax build-up, decreased heat exchange rates, increased pressure drops, etc. Also, the sticky wax tends to agglomerate into irregular shaped larger particles containing substantial amounts of occluded and entrained oil, thereby contributing to decreased dewaxed oil product yields. As stated above, plug flow radial mixing of the wax-oil-solvent mixture in the cooling zone eliminates stagnant cold liquid at the walls of the heat exchanger, thus the low melting point wax is not precipitated until the entire body of flowing solvent-oil mixture is cooled to the crystallization temperature. Consequently the wax crystals formed do not tend to accumulate on the heat exchanger walls. Also, in plug flow radial mixing, the flowing mixture is directed at the heat exchanger walls, thus scouring away any wax which may accumulate thereon. Additionally, with plug flow radial mixing in the cooling zones, wax tends to crystallize evenly throughout the flowing wax-oil-solvent mixture such that mass transfer of crystallizing wax from waxy oil to an existing wax crystal is improved. Such improved mass transfer increases the growth rate of wax crystals and decreases the rate of wax crystal nuclei formation in the cooling zone.

EXAMPLE

In order to demonstrate the process of the present invention, the following example is provided. A solvent neutral oil of SAE-5 grade, derived from Arabian Light crude, is dewaxed according to the process of the present invention. Physical properties of the SAE-5 are given in Table I below:

TABLE I

| | SNO-5 |
|---|---|
| RI/70° C | 1.4532 |
| Density/70° C/(g/ml) | 0.8198 |
| Density/15° C/(g/ml) | 0.8577 |
| Pour Point ° C | +29 |
| Vis./100° F SSU | 16.73 |
| Vis./210° F SSU | 3.66 |

TABLE I-continued

| | SNO-5 |
|---|---|
| VI | 114 |

In the example process, SAE-5 grade oil is mixed with 3.5 volumes of dewaxing solvent comprising 70% MEK and 30% toluene, and the mixture is heated to a temperature of 86° F. (30° C.) for melting all wax present therein. A continuous flow of heated oil-solvent mixture is cooled in a first double pipe heat exchanger 0° C. (32° F.) at a rate of 1° C./min (1.8° F./min) for crystallization of wax nuclei from the waxy oil. From this first cooler, the wax/oil/solvent mixture flows through a first turbular mixer equipped with Kenics (TM) static mixers at a velocity of 0.3 meters/sec for a residence time of 1 minute for equilibrating concentration and temperature gradients. From the first mixer, the wax-/oil/solvent mixture flows to a second double pipe cooler, wherein the mixture is cooled to −10° C. (12° F.) at a rate of 1° C./min (1.8° F./min). From the second cooler, the wax/oil/solvent mixture flows through a second mixer equipped with Kennics (TM) static mixers at a velocity of 0.3 m/sec (1 ft/sec) for a residence time of 1 minute. From this second mixer, the wax/oil/solvent mixture flows to a third double pipe exchanger, wherein the mixture is cooled at 1° C./min (1.8° F./min) to −25° C. (−13° F.).

From the third cooling zone, the wax-oil-solvent mixture is transferred to a vacuum filter operating at 400 mm Hq pressure wherein wax is filtered from the oil-solvent mixture. Upon filtration, the wax filter cake is washed with an amount of solvent equivalent to 2.65 volumes of SAE-5 grade oil charge, and the solvent washed wax cake is air dried for 60 seconds. Dewaxed oil is recovered from the solvent by fractional distillation.

Results of this experiment are shown in Table II, below:

TABLE II

| | |
|---|---|
| Dewaxed Oil Yield (Vol.% SAE-5 charge) | 75.9 |
| Dewaxed Oil Pour Point (° C) | −20 |
| Wax Yield (Wt.% SAE-5 charge) | 18.4 |
| Wax Cake Oil Content (Wt.% SAE-5 charge) | 1.5 |
| Filter Rate (kg oil/m$^2$/hr) | 174 |

Dewaxed oil, having a pour point of −20° C., is recorded in an amount equal to 75.9 volume percent of the SAE-5 charge to the process. Slack wax in an amount equivalent to 18.4 wt.% of the SAE-5 charge is recovered, having entrained therein oil equivalent to 1.5 wt.% of the SAE-5 charge. Thus, by following the method of the present invention dewaxed oil of low pour point, suitable for use in manufacturing lubricating oils, may be produced in good yields. Additionally, slack wax having relatively low amounts of oil entrained therein is also recovered.

We claim:

1. In a solvent dewaxing process for separating solid-wax from a waxy petroleum distillate oil stock, wherein said waxy oil stock, heated to a first temperature sufficient to dissolve all wax therein, is treated with dewaxing solvent in a volume ratio of solvent to oil stock in the range of 1:1 to 5:1 respectively, wherein said mixture of oil and solvent is cooled at a rate of about 1°-8° F./min. to a selected separation temperature in the range of +15° F. to −40° F. for forming a mixture of wax crystals in oil-solvent solution, wherein said wax-/oil/solvent mixture is separated, in a solid-liquid separation zone, into a wax-free oil-solvent solution and slack wax, and wherein said wax-free oil-solvent solution is fractionated, in a fractionation zone, to yield a solvent fraction and a dewaxed oil fraction; the improvement which comprises:

a. cooling, in a first cooling zone, a mixture comprising waxy oil stock and dewaxing solvent in a solvent to oil volume ratio of about 1:1 to 5:1, at a cooling rate of about 1°-8° F.min. to a second temperature about 40°-50° F. above a selected separation temperature for crystallizing wax from said waxy oil-solvent mixture and forming a wax/oil/-solvent mixture;

b. mixing, in a first holding zone, said wax/oil/solvent mixture from said first cooling zone, at about said second temperature, under conditions of plug flow radial mixing, with substantially no heat exchange, for a period of about 30 seconds to about 2 minutes;

c. cooling, in a second cooling zone, said wax/oil/solvent mixture from said first holding zone at a rate of about 1°-8° F.min. under conditions of plug flow radial mixing, to a third temperature about 15°-20° F. above said selected separation temperature for crystallizing additional wax;

d. mixing, in a second holding zone, said wax/oil/solvent mixture, from said second cooling zone, at about said third temperature, under conditions of plug flow radial mixing, with substantially no heat exchange, for a period of about 30 seconds to about 2 minutes;

e. cooling, in a third cooling zone, the wax/oil/solvent mixture from said second holding zone, at a rate of about 1°-8° F.min. to said selected separation temperature for crystallization of additional wax; and f. flowing said wax/oil/solvent mixture from said third cooling zone to said solid-liquid separation zone.

2. The process of claim 1 wherein the cooling rates for said wax/oil/solvent mixture in said first, second, and third cooling zones is in the range of about 1.5°-5° F./min.

3. The process of claim 2 wherein cooling of said wax/oil/solvent mixture in said third cooling zone is under conditions of plug flow radial mixing.

4. The process of claim 3 wherein cooling of said wax/oil/solvent mixture in said second cooling zone is under conditions of plug flow radial mixing.

5. The process of claim 4 wherein residence time and degree of plug flow radial mixing of said wax/oil/solvent mixture in said first holding zone is sufficient for substantially equilibrating crystallization of wax at about said second temperature.

6. The process of claim 5 wherein residence time and degree of plug flow radial mixing of said wax/oil/solvent mixture in said second holding zone is sufficient for substantially equilibrating crystallization of wax at about said third temperature.

7. The process of claim 6 wherein cooling of said wax/oil/solvent mixture in said first cooling zone is under conditions of plug flow radial mixing.

* * * * *